US011918069B2

(12) United States Patent
Higashide

(10) Patent No.: US 11,918,069 B2
(45) Date of Patent: Mar. 5, 2024

(54) MOTORCYCLE HELMET

(71) Applicant: SPORTS-NET Co., Ltd., Osaka (JP)

(72) Inventor: Kosuke Higashide, Osaka (JP)

(73) Assignee: SPORTS-NET CO., LTD. (JP)

( * ) Notice: Subject to any disclaimer, the term of this patent is extended or adjusted under 35 U.S.C. 154(b) by 0 days.

(21) Appl. No.: 17/641,919

(22) PCT Filed: Jul. 16, 2021

(86) PCT No.: PCT/JP2021/026858
§ 371 (c)(1),
(2) Date: Mar. 10, 2022

(87) PCT Pub. No.: WO2023/286279
PCT Pub. Date: Jan. 19, 2023

(65) Prior Publication Data

US 2023/0014990 A1 Jan. 19, 2023

(51) Int. Cl.
*A42B 3/18* (2006.01)

(52) U.S. Cl.
CPC ..... *A42B 3/18* (2013.01)

(58) Field of Classification Search
CPC ..... A42B 3/0406; A42B 3/18; A42B 3/185; A42B 3/20; A42B 3/22; A42B 3/221;
(Continued)

(56) References Cited

U.S. PATENT DOCUMENTS 4,027,354 A * 6/1977 Burpee ..... A42B 3/26 74/25
4,058,854 A * 11/1977 Rhee ..... A42B 3/18 2/412
(Continued)

FOREIGN PATENT DOCUMENTS

CN 110740653 A 1/2020
DE 102012207588 A1 11/2013
(Continued)

OTHER PUBLICATIONS

SQQP Front Window Windshield Wiper Arm & Blade Decoration Cover Trim for 2007-2018 Jeep Wrangler JK(Red), Jul. 21, 2021, https://www.amazon.com/SQQP-Windshield-Decoration-2007-2017-Wrangler/dp/B095GXPJG1/ref=cm_cr_arp_d_product_top?ie=UTF8&th=1, pp. 1-7 (Year: 2001).*
(Continued)

*Primary Examiner* — Alissa L Hoey
(74) *Attorney, Agent, or Firm* — OSTROLENK FABER LLP

(57) ABSTRACT

A motorcycle helmet which can drastically improve motorcycle driving technique and skill. A motorcycle helmet is provided with a helmet body configured to partially or entirely cover a head of a wearer and having an opening in front of a face surface of the wearer, and a gaze corrector provided in a center of a frame forming the opening in the helmet body to divide the opening and being an angular columnar body and enabling correction of a gaze of the wearer. The gaze corrector has mutually different colors on a facing surface facing the wearer, a right side surface located to the right of the facing surface and a left side surface located to the left of the facing surface, and the gaze corrector divides a field of view of the wearer into a right field of view and a left field of view.

4 Claims, 8 Drawing Sheets

(58) Field of Classification Search
CPC ..... A42B 3/222; A42B 3/225; A42B 3/226; A42B 3/227; A42B 3/228; A42B 3/24; A42B 3/26; A42B 3/042
USPC ..... 2/15
See application file for complete search history.

(56) References Cited

U.S. PATENT DOCUMENTS

| | | | | |
|---|---|---|---|---|
| 4,686,712 | A * | 8/1987 | Spiva | A61F 9/027 2/202 |
| 4,722,101 | A | 2/1988 | Blower | 2/422 |
| 4,817,633 | A * | 4/1989 | McStravick | A61B 5/6814 600/595 |
| 4,918,753 | A * | 4/1990 | Mermillod | A42B 3/185 2/10 |
| 6,047,400 | A * | 4/2000 | Spencer | A42B 3/20 2/9 |
| 6,295,653 | B1 | 10/2001 | Puleo | 2/424 |
| 8,555,423 | B2 * | 10/2013 | Giroux | A42B 3/185 2/422 |
| 9,072,331 | B2 * | 7/2015 | McNeal | A42B 3/185 |
| 11,013,287 | B2 * | 5/2021 | Daburn | A42B 3/185 |
| 11,029,542 | B2 * | 6/2021 | Morris | G02C 7/16 |
| 11,679,057 | B2 * | 6/2023 | Higashide | A61H 5/00 601/37 |
| 2001/0039674 | A1 | 11/2001 | Shida | 2/414 |
| 2007/0226882 | A1 * | 10/2007 | Ryan | A61F 9/025 2/426 |
| 2008/0000016 | A1 | 1/2008 | Kellogg | 2/410 |
| 2008/0184464 | A1 * | 8/2008 | Chen | A42B 3/26 2/427 |
| 2010/0186153 | A1 * | 7/2010 | Reyes | A61F 9/029 2/427 |
| 2011/0072564 | A1 * | 3/2011 | Krauter | A42B 3/185 2/452 |
| 2011/0265237 | A1 * | 11/2011 | Lazar | A42B 3/185 2/10 |
| 2013/0298318 | A1 * | 11/2013 | Rogers | A61F 9/027 2/439 |
| 2014/0173811 | A1 * | 6/2014 | Finiel | A42B 3/04 2/422 |
| 2016/0037853 | A1 | 2/2016 | Ikeda | |
| 2017/0056742 | A1 * | 3/2017 | Glynn | A63B 71/00 |
| 2018/0108238 | A1 | 4/2018 | Chen et al. | |
| 2019/0000674 | A1 * | 1/2019 | Bouchard Fortin | A42B 3/185 |
| 2020/0081272 | A1 * | 3/2020 | Morris | G02C 7/16 |
| 2021/0106092 | A1 | 4/2021 | Shida et al. | |
| 2021/0275384 | A1 * | 9/2021 | Higashide | A61H 5/00 |
| 2022/0107512 | A1 * | 4/2022 | Messiou | G02C 11/12 |

FOREIGN PATENT DOCUMENTS

| | | | |
|---|---|---|---|
| DE | 102014218576 | A1 | 3/2016 |
| DE | 102015220697 | A1 | 4/2017 |
| EP | 3750513 | A1 | 12/2020 |
| JP | 2001-316929 | A | 11/2001 |
| JP | 2010-209492 | A | 9/2010 |
| JP | 2016-037669 | | 3/2016 |
| JP | 2020-177153 | A | 10/2020 |

OTHER PUBLICATIONS

Schutt Youth Defender's Tie Dye Mask , Aug. 27, 2020, https://www.hibbett.com/schutt-youth-defenders-tie-dye-mask/V1503.html, pp. 1-9 (Year: 2020).*

Office Action dated Mar. 14, 2022 for corresponding Japanese Patent Application No. 2022-507370 with English translation.

Office Action dated Apr. 29, 2022 for corresponding Australian Patent Application No. 2021355605.

International Search Report dated Aug. 24, 2021 in corresponding PCT International Application No. PCT/JP2021/026858.

Written Opinion dated Aug. 24, 2021 in corresponding PCT International Application No. PCT/JP2021/026858.

Office Action dated Jun. 10, 2022 issued in corresponding Chinese Patent Application No. 202180004996.1 with English translation.

Decision of Refusal dated Jul. 29, 2022 issued in corresponding Japanese Patent Application No. 2022-507370 with English translation.

Decision of Refusal issued by the Chinese Patent Office dated Apr. 19, 2023 for the corresponding Chinese Patent Application No. 202180004996.1, and its English translation.

* cited by examiner

MOTORCYCLE HELMET

CROSS-REFERENCE TO RELATED APPLICATIONS

The present application is a 35 U.S.C. §§ 371 national phase conversion of International Application No. PCT/JP2021/026858, filed Jul. 16, 2021, the content of which is incorporated herein by reference.

TECHNICAL FIELD

The present invention relates to a motorcycle helmet and, more particularly to a motorcycle helmet capable of drastically improving motorcycle driving technique and skill.

BACKGROUND ART

A posture of a motorcycle needs to be maintained in equilibrium during driving. The posture control during driving is difficult, for example, as compared to four-wheeled vehicles. To control the motorcycle during driving and stabilize the motorcycle during driving by maintaining balance, driver's driving technique and skill are also largely related besides performances such as motion characteristics and vehicle stability of the motorcycle. Particularly, a force applied to a steering system in turning around a curve and the driver's physical motion and displacement including a weight shift largely differ depending on the driver's driving technique and skill and are directly linked to driving safety. Therefore, it becomes an important issue to improve the driver's driving technique and skill.

Here, patent literature 1 discloses, for example, a helmet capable of satisfactorily ensuring a field of view in front of and above the helmet while maintaining the fitting of the helmet even if a driver takes an extremely forward leaning posture. According to patent literature 1, even if the driver largely inclines a riding posture and takes a low posture in turning around a curve, it can be prevented that a view on a front-upper side becomes difficult to see. However, even if the field of view in front of and above the driver can be satisfactorily ensured, it is difficult to improve the driver's driving technique and skill in turning around a curve.

PRIOR ART DOCUMENTS

Patent Documents

Patent Document 1: JP 2016-037669A

SUMMARY OF INVENTION

Technical Problem

The present invention was developed in view of the above problem and aims to provide a motorcycle helmet capable of drastically improving motorcycle driving technique and skill.

Means for Solving the Problems

In order to solve the aforementioned problem, the motorcycle helmet according to the present invention is a motorcycle helmet includes a helmet body that partially or entirely covers a head of a wearer and having an opening in front of a face surface of the wearer, and a gaze corrector provided in a center of a frame forming the opening in the helmet body to divide the opening, having a rectangular columnar shape and enabling correction of a gaze of the wearer, wherein the gaze corrector has mutually different colors on a facing surface facing the wearer, a right side surface located to the right of the facing surface and a left side surface located to the left of the facing surface, and the gaze corrector divides a field of view of the wearer into a right field of view and a left field of view.

In the above configuration, the gaze corrector is preferably attachably and detachably provided in the center of the frame.

Further, in order to solve the aforementioned problem, the motorcycle helmet according to the present invention is a motorcycle helmet includes a helmet body that partially or entirely covers a head of a wearer and having an opening in front of a face surface of the wearer, a shield rotatably supported on the helmet body to at least partially cover the opening at a lowered position and release the opening at an elevated position, and a gaze corrector provided in a center of at least either one of an outer side surface and an inner side surface of the shield and being an angular columnar body and enabling correction of a gaze of the wearer, wherein the gaze corrector has mutually different colors on a facing surface facing the wearer, a right side surface located to the right of the facing surface and a left side surface located to the left of the facing surface, and the gaze corrector divides a field of view of the wearer into a right field of view and a left field of view.

In the above configuration, preferably, a pair of holding parts projecting from the outer side surface or inner side surface to hold the gaze corrector are provided on the outer side surface or inner side surface of the shield provided with the gaze corrector, one of the pair of holding parts is provided with a fitting groove to be fitted to at least a part of an upper part of the gaze corrector, and the other of the pair of holding parts is provided with another fitting groove to be fitted to at least a part of a lower part of the gaze corrector.

Advantageous Effects of Invention

According to the present invention, the gaze corrector enabling the correction of the gaze of the wearer (driver) is provided in the center of the frame forming the opening of the helmet body. Alternatively, the gaze corrector is provided in the center of at least either one of the outer and inner side surfaces of the shield. This gaze corrector is in the form of an angular columnar body, and the right side surface thereof located to the right of the facing surface facing the wearer and the left side surface thereof located to the left of the facing surface have mutually different colors.

Here, in turning around a curve to right or left during the driving of the motorcycle, the wearer may tilt a vehicle body in a turning direction by shifting a weight on the vehicle body. This enables smooth cornering utilizing characteristics to naturally turn toward a side to which front and rear wheels lean, i.e. so-called self-steering characteristics. Here, when the vehicle body is tilted in the turning direction, the gaze (visual line) of the wearer is preferably in a stable state (fixed state) in the turning direction of the vehicle body. In this way, the orientation of the head, a weight shift and body inclination can be controlled, and smooth cornering becomes possible. If the gaze is not fixed with respect to the turning direction of the vehicle body and the position of the head is unstable, the weight cannot be smoothly shifted when the vehicle body is turning toward an opposite side, thereby causing an accident such as because the vehicle body runs off a road without being able to turn or because the vehicle body falls over toward an inner side of the road. However, the motorcycle helmet of the present invention is configured to have the gaze corrector in the center of the frame of the helmet body or in the center of at least either one of the outer and inner side surfaces of the shield. In this gaze corrector, the right side surface located to the right of the facing surface facing the wearer and the left side surface to the left of the facing surface have different colors. Thus, when the vehicle is going to turn to right, the color of the left side surface can be visually confirmed in the left field of view of the wearer. On the other hand, when the vehicle is going to turn to left, the color of the right side surface can be visually confirmed in the right field of view of the wearer. In this way, by causing the wearer to visually confirm the color of the right or left side surface of the gaze corrector in the field of view on a side opposite to the turning direction of the vehicle when the wearer is turning around a curve to right or left, it can be corrected that the wearer tries to turn around a curve constantly using a dominant eye. This enables the wearer to smoothly turn around a curve regardless of the roundness (curvature radius) of the curve, and driving technique and skill, particularly driving technique and skill when the vehicle is turning around a curve can be drastically improved. As a result, for example, the risk of falling over on the curve can be reduced and driving safety can be improved.

DESCRIPTION OF EMBODIMENTS

First Embodiment

Figure 1:
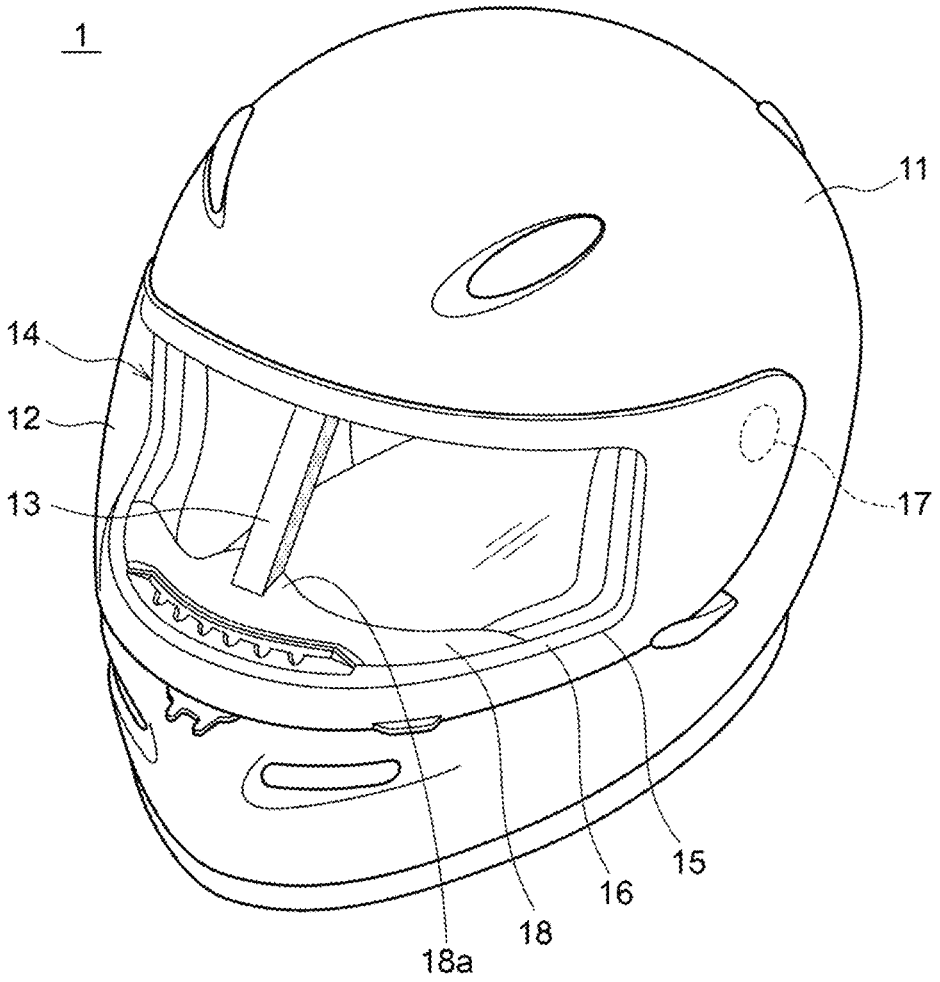
FIG. 1 is a perspective view schematically showing a motorcycle helmet according to a first embodiment of the present invention.
Figure 2:
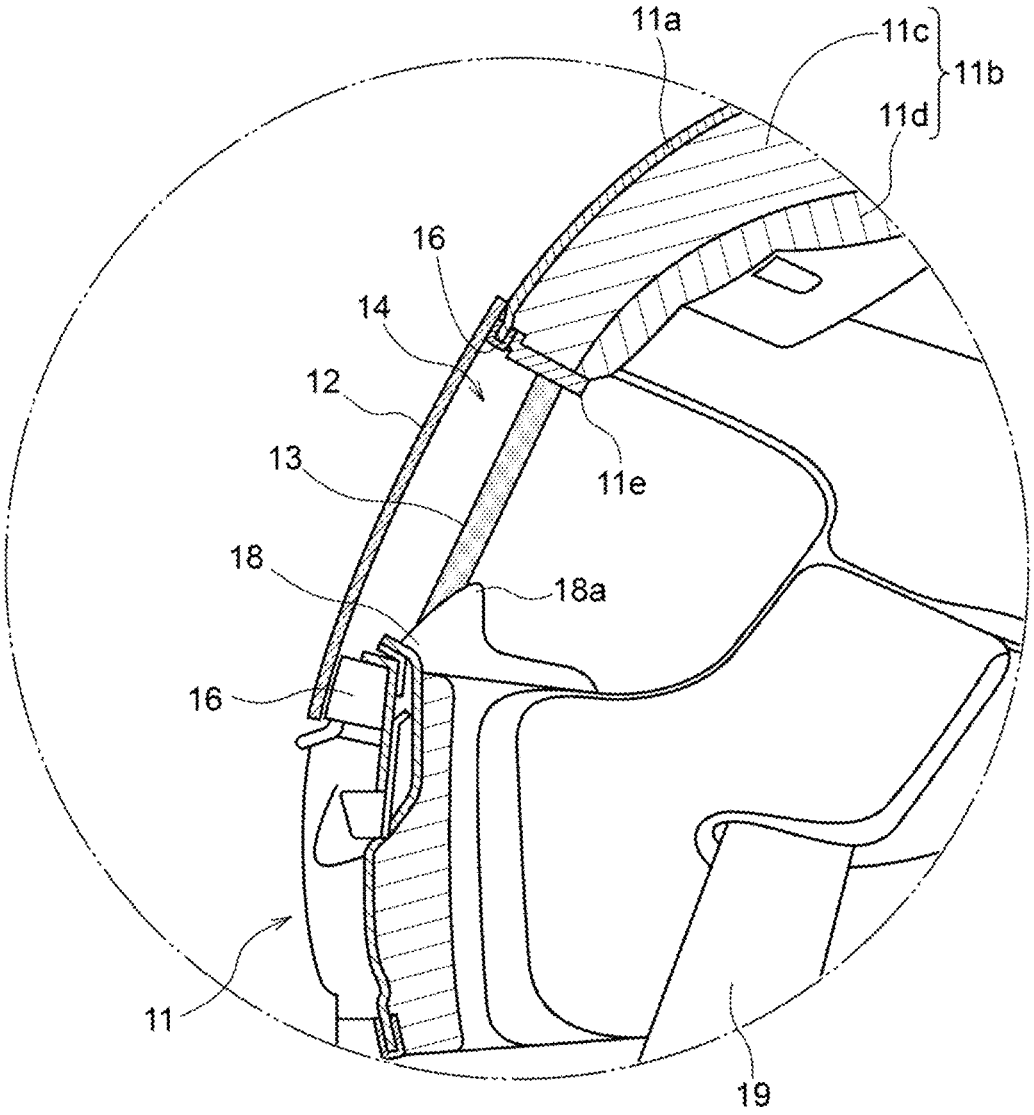
FIG. 2 is a sectional view schematically showing an essential part of the motorcycle helmet according to the first embodiment of the present invention.
Figure 3A:
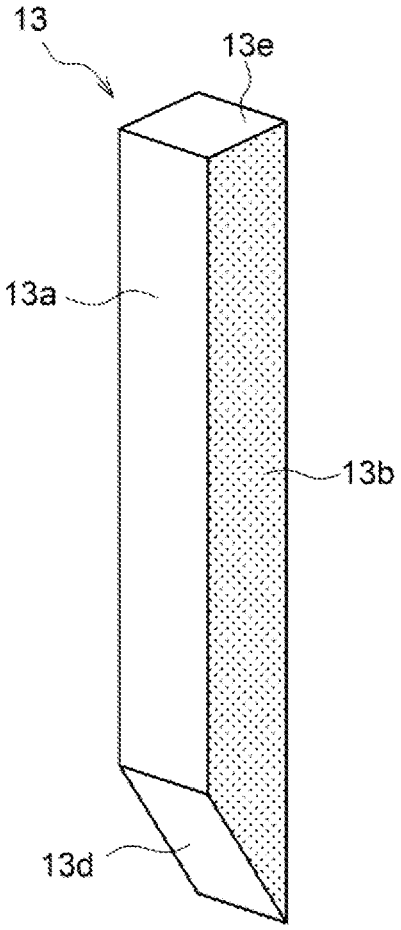
FIGS. 3A and 3B are perspective views schematically showing a gaze corrector in the motorcycle helmet according to the first embodiment of the present invention.
Figure 3B:
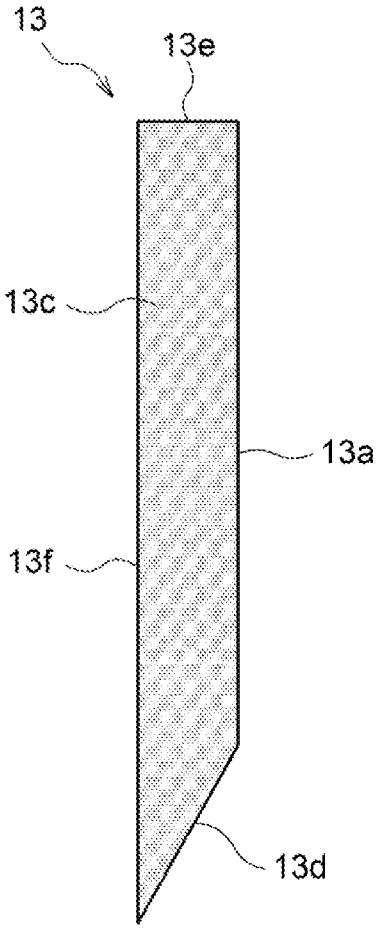
Figure 4:
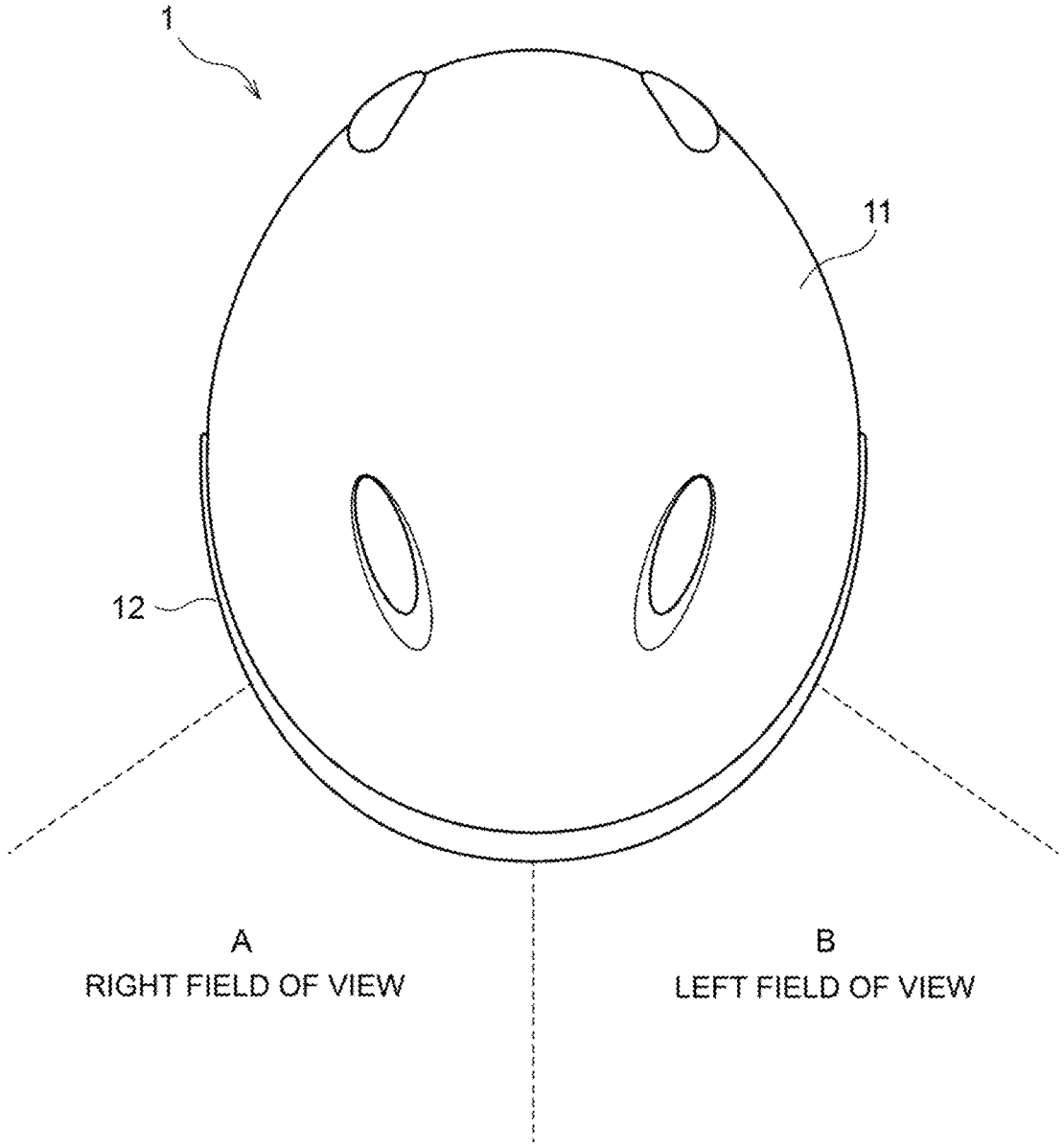
FIG. 4 is a plan view schematically showing the motorcycle helmet according to the first embodiment of the present invention.

A motorcycle helmet (hereinafter, referred to as a "helmet") according to a first embodiment of the present invention is described below with reference to FIGS. 1 to 4. FIG. 1 is a perspective view schematically showing the helmet according to the present embodiment. FIG. 2 is a sectional view schematically showing an essential part of the helmet. FIGS. 3A and 3B are perspective views schematically showing a gaze corrector in the helmet. FIG. 4 is a plan view schematically showing the helmet. It should be noted that, in each figure, parts unnecessary for description are not shown and some parts may be shown in an enlarged or reduced manner to facilitate description.

The helmet 1 according to the present embodiment is a full face helmet at least provided with a helmet body 11, a shield 12 and a gaze corrector 13 as shown in FIG. 1. The helmet 1 of the present embodiment is, for example, suitable for motorcycle and mainly functions to protect the head and face of a wearer (driver) of the helmet 1 in the event of an accident. The helmet 1 also has a function of ensuring a field of view of the wearer and cutting off various harsh noises generated during the driving of the motorcycle such as engine sounds to a certain extent.

The helmet body 11 protects the head of the wearer by partially or entirely covering the head of the wearer. The helmet body 11 has an outer shell 11*a* and an inner shell 11*b*. The outer shell 11*a* is made of a hard material. Polycarbonate, ABS (acrylonitrile butadiene styrene), glass fiber, carbon fiber, aramid fiber or the like can be, for example, cited as this hard material. The inner shell 11*b* has a shock absorption liner 11*c* and a breathable head back cover 11*d* provided on the shock absorption liner 11*c*. The head back cover 11*d* is partially attached to the inner side surface of the shock absorption liner 11*c* by adhesion using an adhesive, double-sided adhesive tape or the like. Further, a lower end part of the head back cover 11*d* is attached to the outer shell 11*a* and the shock absorption liner 11*c* by a holding part 11*e*. A constituent material of the shock absorption liner 11*c* is not particularly limited and, for example, foamed polystyrene or the like can be cited as such.

The helmet body 11 is provided with a frame 15 for forming an opening 14 on a side in front of the face of the wearer. An edge member 16 is provided on the entire periphery of the frame 15 by adhesion or the like. A constituent material of the edge member 16 is not particularly limited and, for example, a flexible elastic material such as synthetic rubber can be cited as such.

Further, the frame 15 is provided with a breath guard 18 extending inward along the inner surface of the peripheral edge of a lower part thereof. The breath guard 18 prevents the inner side surface of the shield 12 from being fogged due to the wearer's breath by covering the wearer's nose when the helmet is worn, and functions as a breath guiding plate. The overall shape of the breath guard 18 is arched and a raised portion 18*a* raised upward is provided in a central part of the breath guard 18. The raised portion 18*a* has a function of covering the nose of the wearer. The breath guard 18 can be, for example, configured by covering the surface of a cushioning member made of a polyethylene foam material or the like with a vinyl chloride leather or the like and covering the back surface of the cushioning member with a cloth such as a nylon pile fabric.

The helmet body 11 may also be provided with a jaw strap 19 or the like used to wear the helmet 1 (see FIG. 2). Detailed conditions such as the shapes, structures and materials of the outer shell 11*a*, the inner shell 11*b*, the jaw strap 19 and the like can be appropriately set without being particularly limited.

A pair of couplings 17 for rotatably coupling the shield 12 are provided on side surfaces of the helmet body 11 (more specifically, the outer shell 11*a*). The installation positions of the couplings 17 are not particularly limited as long as these positions are on the outer side surfaces of the outer shell 11*a*, and may be appropriately set in consideration of the type, number and the like of the couplings 17. The type of the couplings 17 is not particularly limited and, for example, buttons, bolts and nuts, or male-female type coupling means can be adopted as such. Further, holes may be provided in the side surfaces of the outer shell 11*a* and the shield 12 may be coupled and fixed to the outer shell 11*a* by pins, screws or the like. Furthermore, the shield 12 may be so coupled by the couplings 17 as to be attachable to and detachable from the helmet body 11.

The shield 12 can protect the face and eyes of the wearer from wind and flying objects (e.g. pebbles, insects, trash) from front and ensure a field of view. The shield 12 is attached to the outer shell 11*a* by the pair of left and right couplings 17 on both end parts thereof. The shield 12 can be elevated and lowered by being rotated about the couplings 17. The shield 12 can be elevated and lowered between a lowered position where the opening 14 can be completely or partially covered and an elevated position where the opening 14 is released. A position where the opening 14 is covered by the shield 12 coincides with a position where the shield 12 is completely lowered. On the other hand, a position where the shield 12 releases the opening 14 coincides with a position where the shield 12 is completely elevated. Further, the shield 12 has optical transparency. In this way, also when the shield 12 covers the opening 14, the wearer can visually confirm outside via the shield 12.

The shape of the shield 12 can be appropriately set if necessary in view of the opening shape of the opening 14. The shape of the shield 12 is not particularly limited if the shield 12 at least partially covers the opening 14. For example, if the shield 12 is shaped to be held in close contact with the edge member 16, the opening 14 can be covered without leaving any gap by the shield 12. This prevents wind and the like from intruding through a gap between the shield 12 and the opening 14 when the wearer drives the motorcycle, and ensures a field of view and the like in a further improved manner.

A material of the shield 12 is not particularly limited and, for example, a polymer material such as polycarbonate can be cited as such. Further, a coating liquid for imparting ultraviolet reflectivity may be applied to the surface of the shield 12 or a film or the like may be adhered to the surface of the shield 12, such as for the purpose of preventing ultraviolet rays and preventing the damage of the shield 12. Further, the color, structure and the like of the shield 12 are also not particularly limited and can be appropriately set if necessary.

The gaze corrector 13 has a rectangular parallelepiped overall shape and is, as shown in FIGS. 1 and 2, provided to be located in a center of the frame 15. The gaze corrector 13 preferably does not abut on the face surface of the wearer when the helmet 1 is worn. Further, the gaze corrector 13 may or may not abut on the inner side surface of the shield 12 when the shield 12 covers the opening 14.

An upper surface 13*e* of the gaze corrector 13 is a flat surface parallel to a horizontal direction as shown in FIGS. 3A and 3B. The upper surface 13*e* is bonded in close contact with the holding part 11*e* on the upper end of the frame 15. A bonding method is not particularly limited and, for example, adhesion by an adhesive or the like can be cited as such. It should be noted that the upper surface 13*e* of the gaze corrector 13 is not limited to the flat surface. The upper surface 13*e* may be, for example, an inclined surface or the like according to the shape of the edge member 16 on the upper end of the frame 15 to be bonded.

Further, a lower surface 13*d* of a lower part of the gaze corrector 13 is an inclined surface inclined toward the facing surface 13*a* to reduce an area of a facing surface 13*a*. The lower surface 13*d* is bonded in close contact with the raised portion 18*a* in the breath guard 18 of the frame 15. A bonding method is not particularly limited and, for example, adhesion by an adhesive or the like can be cited as such. It should be noted that how much the lower surface 13*d* of the lower part in the gaze corrector 13 is inclined is not particularly limited and can be appropriately set according to the shape of the raised portion 18*a* to be bonded. For example, the lower surface 13*d* may be a flat surface parallel to the horizontal direction.

In the gaze corrector 13, the facing surface 13*a* (first surface) facing the wearer, a right side surface 13*b* second surface) located to the right of the facing surface 13*a* and a left side surface 13*c* (third surface) located to the left of the facing surface 13*a* have at least mutually different colors. In this way, the field of view of the wearer can be divided into a right field of view A and a left field of view B (see FIG. 4). When the wearer directs his/her gaze in a direction of the left field of view, the right eye can visually confirm the color of the right side surface 13*b*. On the contrary, when the wearer directs his/her gaze in a direction of the right field of view, the left eye can visually confirm the color of the left side surface 13*c*. Further, the facing surface 13*a* has the color different from those of the right side surface 13*b* and left side surface 13*c* to enable the colors of the right side surface 13*b* and left side surface 13*c* to be clearly visually confirmed. In this way, in switching an advancing direction of the motorcycle, the color of the facing surface 13*a* can be visually confirmed. It should be noted that the color of a surface 13*f* opposite to the facing surface 13*a* in the gaze corrector 13 is arbitrary without being particularly limited.

Further, the gaze corrector 13 is not limited to the one having a rectangular parallelepiped shape and may be in the form of an angular columnar body such as a polygonal column. Further, a combination of the colors of the facing surface 13*a*, the right side surface 13*b* and the left side surface 13*c* is not particularly limited. For example, a color combination having mutually large color differences is preferable, such as by making the facing surface 13*a* black, the right side surface 13*b* red and the left side 13*c* blue.

A rigid or elastic material excellent in processability is preferable as a constituent material of the gaze corrector 13. For example, if the gaze corrector 13 does not abut on the face surface of the wearer, the gaze corrector 13 may be rigid. Further, in terms of improving the safety of the wearer, the gaze corrector 13 is preferably elastic. Specific examples of the constituent material of the gaze corrector 13 include, for example, polymer resins such as polycarbonate and low-resilience sponges and rubbers.

It should be noted that an exemplary case where the upper surface 13*e* of the gaze corrector 13 has a flat surface parallel to the horizontal direction and the lower surface 13*d* thereof has an inclined surface has been described in the first embodiment. However, the present invention is not limited to this aspect. These surfaces can be appropriately changed to be held in close contact with the holding part 11*e* and the breath guard 18 according to the surface shapes of the holding part 11*e* and the breath guard 18.

Further, an exemplary case where the gaze corrector 13 is held in close contact with each of the holding part 11*e* and the raised portion 18*a* of the breath guard 18 has been described in the first embodiment. However, the present invention is not limited to this aspect. For example, the elastic gaze corrector 13 may be deformed by being pressed in a longitudinal direction thereof, thereby being held between the holding part 11*e* and the raised portion 18*a* of the breath guard 18. By pressing and deforming the gaze corrector 13 in the longitudinal direction thereof, the gaze corrector 13 can be held between the holding part 11*e* and the raised portion 18*a* by the action of a force restoring to an initial shape. In this case, the gaze corrector 13 can be made attachable to and detachable from the helmet body 11.

Furthermore, the gaze corrector 13 may be so provided that the upper surface 13*e* and/or the lower surface 13*d* thereof is/are bonded or held in close contact with the edge member 16 of the frame 15. In this case, the shapes of the upper and lower surfaces 13*e*, 13*d* of the gaze corrector 13 are preferably appropriately changed to be sufficiently in close contact with the edge member 16.

Second Embodiment

Figure 5:
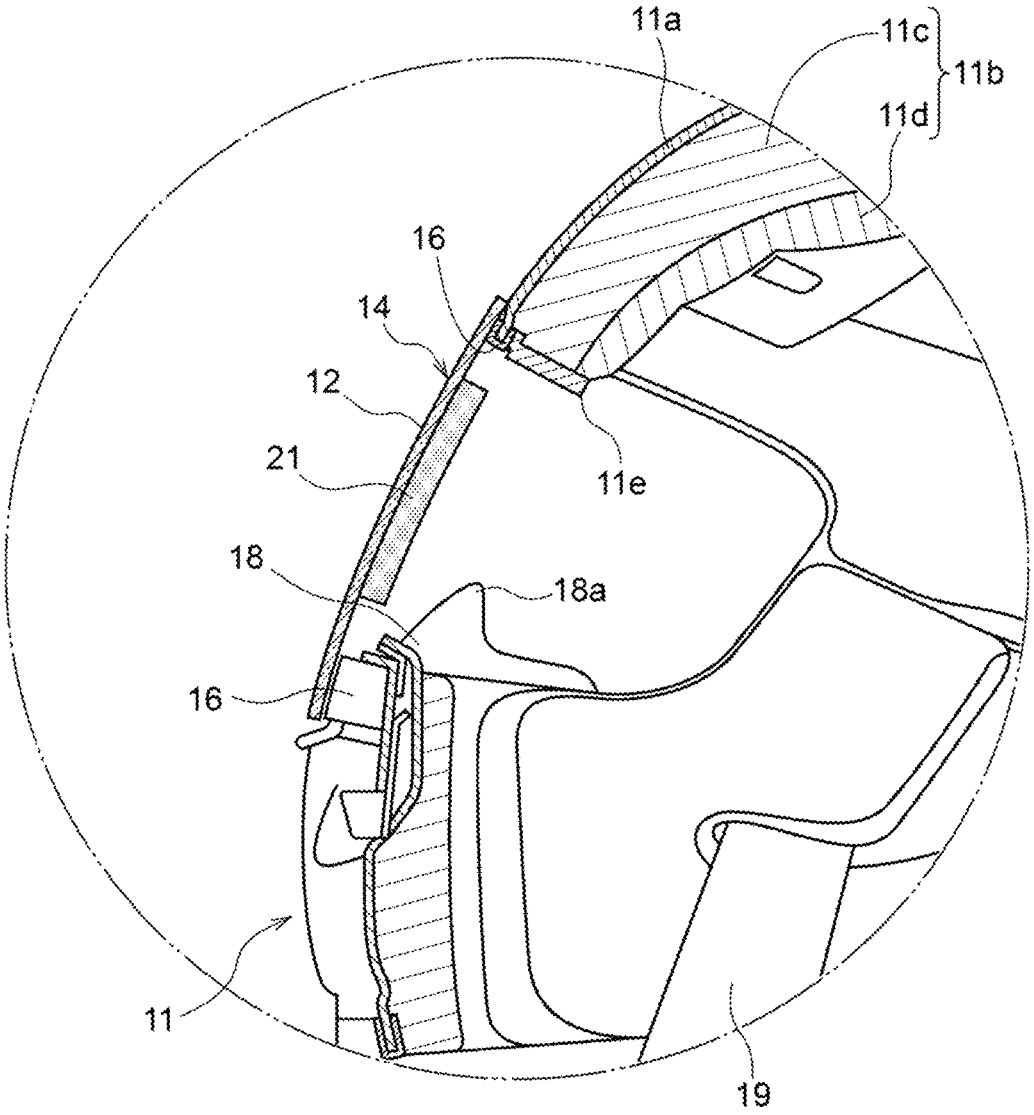
FIG. 5 is a sectional view schematically showing an essential part of a motorcycle helmet according to a second embodiment of the present invention.
Figure 6:
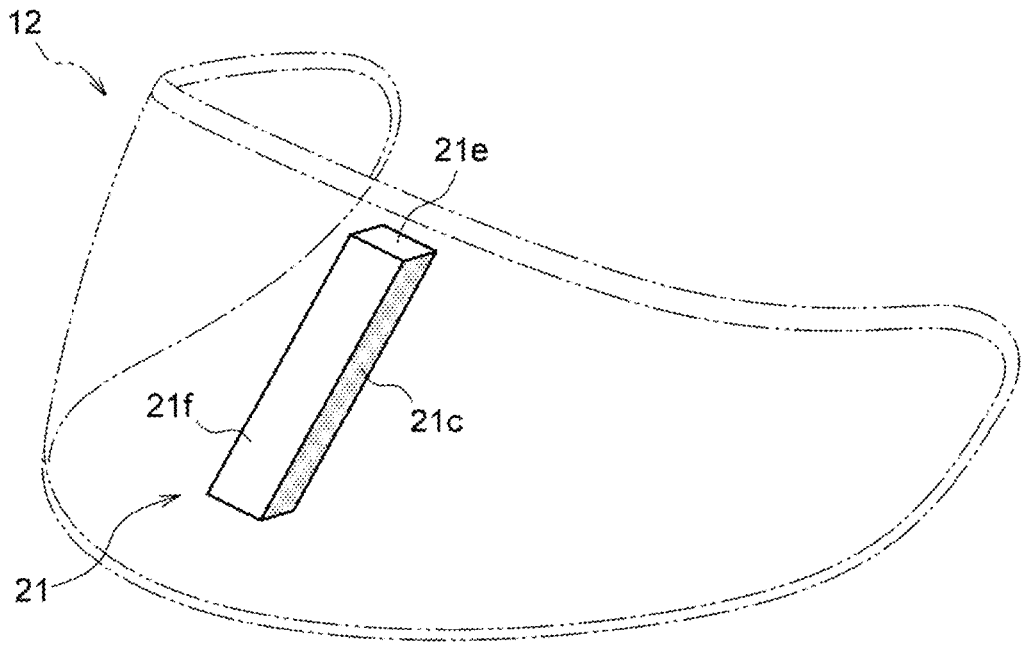
FIG. 6 is a perspective view schematically showing a shield of the motorcycle helmet according to the second embodiment of the present invention.
Figure 7A:
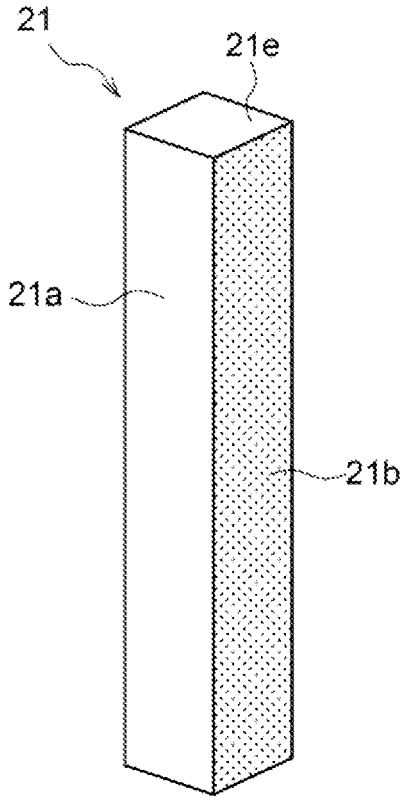
FIGS. 7A and 7B are perspective views schematically showing a gaze corrector in the motorcycle helmet according to the second embodiment of the present invention.
Figure 7B:
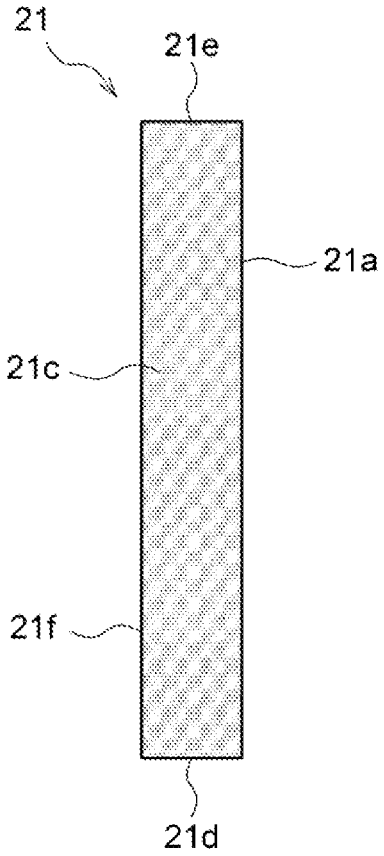

Next, a helmet according to a second embodiment of the present invention is described below with reference to FIGS. 5 to M. FIG. 5 is a sectional view schematically showing an essential part of a helmet according to the second embodiment. FIG. 6 is a perspective view schematically showing a shield of the helmet. FIGS. 7A and 7B are perspective views schematically showing a gaze corrector in the helmet.

The helmet according to the second embodiment differs from the helmet according to the first embodiment in that a gaze corrector 21 is provided on an inner side surface of a shield 12 as shown in FIGS. 5 and 6.

The gaze corrector 21 has a rectangular parallelepiped overall shape and is so provided in a center of the shield 12 that both end parts do not deviate from the shield 12. In this way, the shield 12 can cover an opening 14 without leaving any gap when covering the opening 14 at a lowered position. Further, the gaze corrector 21 preferably has such a size that a facing surface 21*a* facing a wearer does not abut on the face surface of the wearer when the shield 12 covers the opening 14 at the lowered position. Furthermore, the gaze corrector 21 preferably has such a size as not to abut on an outer shell 11*a* of a helmet body 11 at an elevated position for releasing the opening 14.

In the gaze corrector 21, a surface 21*f* opposite to the facing surface 21*a* is bonded in close contact with the inner side surface of the shield 12. A bonding method is not particularly limited and, for example, adhesion by a pressure sensitive adhesive, adhesive, double-sided adhesive tape or the like can be cited as such.

In the gaze corrector 21, the facing surface 21*a*, a right side surface 21*b* located to the right of the facing surface 21*a* and a left side surface 21*c* located to the left of the facing surface have at least mutually different colors. In this way, a field of view of the wearer can be divided into a right field of view A and a left field of view B (see FIG. 4). When the wearer directs his/her gaze in a direction of the left field of view, the right eye can visually confirm the color of the right side surface 21*b*. On the contrary, when the wearer directs his/her gaze in a direction of the right field of view, the left eye can visually confirm the color of the left side surface 21*c*. Further, the facing surface 21*a* has the color different from those of the right and left side surfaces 21*b*, 21*c* to enable the colors of the right and left side surfaces 21*b*, 21*c* to be clearly visually confirmed. In this way, in switching an advancing direction of a motorcycle, the color of the facing surface 21*a* can be visually confirmed. It should be noted that the color of the surface 21*f* opposite to the facing surface 21*a* in the gaze corrector 21 is arbitrary without being particularly limited.

As shown in FIGS. 7A and 7B, an upper surface 21*e* and a lower surface 21*d* of the gaze corrector 21 are respectively flat surfaces parallel to a horizontal direction. It should be noted that the upper and lower surfaces 21*e*, 21*d* of the gaze corrector 21 are not limited to the flat surfaces and may be, for example, inclined surfaces or surfaces having a stepped shape.

Further, the gaze corrector 21 is not limited to the one having a rectangular parallelepiped shape and may be in the form of an angular columnar body such as a polygonal column. Further, a combination of the colors of the facing surface 21*a*, the right side surface 21*b* and the left side surface 21*c* is not particularly limited. For example, a color combination having mutually large color differences is preferable, such as by making the facing surface 21*a* black, the right side surface 21*b* red and the left side 21*c* blue.

A rigid or elastic material excellent in processability is preferable as a constituent material of the gaze corrector 21. In the second embodiment, the gaze corrector 21 is preferably elastic to be able to follow a curved shape of the shield 12. Specific examples of the constituent material of the gaze corrector 21 include, for example, polymer resins such as polycarbonate and low-resilience sponges and rubbers.

It should be noted that an exemplary case where the surface 21*f* of the gaze corrector 21 opposite to the facing surface 21*a* is bonded in close contact with the inner side surface of the shield 12 has been described in the second embodiment. However, the present invention is not limited to this aspect. For example, the gaze corrector 21 may be bonded in close contact with the outer side surface of the shield 12. In this case, the gaze corrector 21 is provided to project outward on the outer side surface of the shield 12. Further, the facing surface 21*a* of the gaze corrector 21 is bonded in close contact with the outer side surface of the shield 12. A bonding method for the gaze corrector 21 and the outer side surface of the shield 12 is not particularly limited and, for example, adhesion by a pressure sensitive adhesive, adhesive, double-sided adhesive tape or the like can be cited as such. In the case of bonding by a glue, the gaze corrector 21 can be made attachable to and detachable from the shield 12. Further, the gaze corrector 13 according to the aforementioned first embodiment may be provided in a center of the frame 15 and used together with the gaze corrector 21 of this embodiment.

Figure 8:
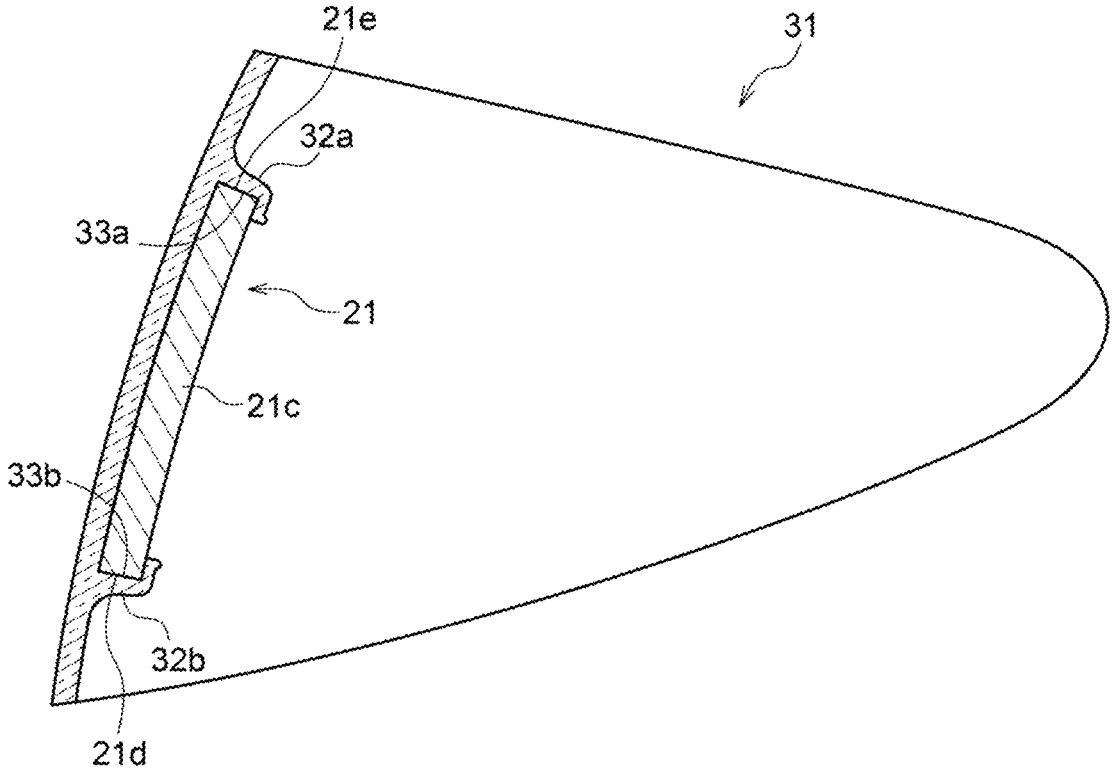
FIG. 8 is a sectional view schematically showing another shield of the motorcycle helmet according to the second embodiment of the present invention.

Further, in the second embodiment, a pair of holding parts 32 separated from each other in a vertical direction of the inner side surface of a shield 31 may be provided and the gaze corrector 21 may be held by this pair of holding parts 32 as shown in FIG. 8. FIG. 8 is a sectional view schematically showing the shield 31. In the gaze corrector 21 to be held by the pair of holding parts 32, the surface 21*f* opposite to the facing surface 21*a* is held in close contact with the inner side surface of the gaze corrector 31. However, the present invention is not limited to this aspect. The surface 21*f* of the gaze corrector 21 may be separated from the inner side surface of the shield 31.

The pair of holding parts 32 are provided to project toward the wearer. Further, the pair of holding parts 32 are integrally molded to the shield 31. However, the present invention is not limited to this aspect and, for example, the pair of holding parts 32 may be bonded to the inner side surface of the shield 31 by an adhesive or the like.

One (upper holding part 32*a*) of the pair of holding parts 32 is provided with a fitting groove portion 33*a* into which an upper part of the gaze corrector 21 is fittable by accommodating the upper surface 21*e* of the gaze corrector 21. Further, the other (lower holding part 32*b*) of the pair of holding parts 32 is provided with a fitting groove portion 33*b* into which a lower part of the gaze corrector 21 is fittable by accommodating the lower surface 21*d* of the gaze corrector 21. In this way, the detachment of the gaze corrector 21 from the shield 31 can be prevented. Further, the gaze corrector 21 is made attachable to and detachable from the shield 31.

It should be noted that a pair of holding parts may be provided on the outer side surface of a shield. In this case, the pair of holding parts are provided to project outward.

Further, although the full face helmet has been described as an example in the second embodiment, the present invention is not limited to this aspect. For example, the helmet may be a jet helmet obtained by omitting a part configured to abut on the jaw of the wearer from the full face helmet. Also in this case, a field of view of the wearer can be divided into a right field of view and a left field of view by providing the gaze corrector 21 in a center of the outer side surface and/or the inner side surface of the shield 12, and the gaze of the wearer can be corrected when the motorcycle is turning around a curve.

LIST OF REFERENCE SIGNS

1 . . . motorcycle helmet, 11 . . . helmet body, 11*a* . . . outer shell, 11*b* . . . inner shell, 11*c* . . . shock absorption liner, 11*d* . . . cover, 11*e* . . . holding part, 12 . . . shield, 13, 21 . . . gaze corrector, 13*a*, 21*a* . . . facing surface, 13*b*, 21*b* . . . right side surface, 13*c*, 21*c* . . . left side surface, 13*d*, 21*d* . . . lower surface, 13*e*, 21*e* . . . upper surface, 13*f*, 21*f* . . . surface opposite to facing surface, 14 . . . opening, 15 . . . frame, 16 . . . edge member, 17 . . . coupling, 18 . . . breath guard, 18*a* . . . raised portion

The invention claimed is:

1. A motorcycle helmet, comprising:

a helmet body having an interior and configured to partially or entirely cover a top of a head of a wearer and having an opening configured to be located in front of a face surface of the wearer when worn; and a gaze corrector provided in a center of a frame forming the opening in the helmet body to divide a field of view of the wearer into a right field of view and a left field of view when worn, the gaze corrector having a rectangular columnar shape with a first surface facing the interior of the helmet body when worn and having a first color, a second surface at one side of the first surface and having a second color, and a third surface at another side of the first surface opposite the one side and having a third color, the second and the third surfaces extending from the first surface away from the interior of the helmet body, wherein the first color, the second color, and the third color are different from each other, wherein, the gaze corrector is positioned so that when the wearer is wearing the helmet and travelling on a motorcycle, and the wearer's gaze is directed in a direction of the left field of view, the wearer's right eye can see the second color of the second surface, and when the wearer's gaze is directed in a direction of the right field of view, the wearer's left eye can see the third color of the third surface, whereby when the wearer switches direction of travel of the motorcycle the first color of the first surface can be seen by the wearer, a surface of an upper end and a surface of a lower end of the gaze corrector are fixed directly to the frame in the center of the frame.

2. The motorcycle helmet according to claim 1, wherein:

the gaze corrector is attachably and detachably provided in the center of the frame.

3. A motorcycle helmet, comprising:

a helmet body having an interior and configured to partially or entirely cover a top of a head of a wearer and having an opening configured to be located in front of a face surface of the wearer when worn;

a shield rotatably supported on the helmet body to close the opening at a lowered position and uncover an area in front of the face surface of the wearer at an elevated position when worn; and a gaze corrector provided in close contact with a center of at least either one of an outer side surface and an inner side surface of the shield and being an angular columnar body and enabling correction of a gaze of the wearer when worn, wherein the gaze corrector is positioned to divide a field of view of the wearer into a right field of view and a left field of view when worn and when the shield covers the opening at the lowered position, the gaze corrector having a first surface facing the interior of the helmet body when worn and having a first color, a second surface located at one side of the first surface and having a second color, and a third surface located at another side of the first surface opposite the one side and having a third color, the second and the third surfaces extending from the first surface away from the interior of the helmet body, wherein the first color, the second color, and the third color are different, and wherein, the gaze corrector is positioned so that when the wearer is wearing the helmet and travelling on a motorcycle, and the wearer's gaze is directed in a direction of the left field of view, the wearer's right eye can see the second color of the second surface, and when the wearer's gaze is directed in a direction of the right field of view, the wearer's left eye can see the third color of the third surface, whereby when the wearer switches direction of travel of the motorcycle the first color of the first surface can be seen by the wearer.

4. The motorcycle helmet according to claim 3, wherein:

a pair of holding parts projecting from the outer side surface or the inner side surface to hold the gaze corrector are provided on the outer side surface or the inner side surface of the shield, one of the pair of holding parts is provided with a fitting groove to be fitted to at least a part of an upper part of the gaze corrector, and the other of the pair of holding parts is provided with another fitting groove to be fitted to at least a part of a lower part of the gaze corrector.

* * * * *